US010930415B2

(12) United States Patent
Rudolf et al.

(10) Patent No.: US 10,930,415 B2
(45) Date of Patent: Feb. 23, 2021

(54) DATA CABLE FOR AREAS AT RISK OF EXPLOSION

(71) Applicant: LEONI KABEL GMBH, Nuremberg (DE)

(72) Inventors: Uwe Rudolf, Ahrensfelde (DE); Maik Stratmann, Friesoythe (DE); Benedikt Engler, Oldenburg (DE)

(73) Assignee: Leoni Kabel GmbH, Roth (DE)

( * ) Notice: Subject to any disclaimer, the term of this patent is extended or adjusted under 35 U.S.C. 154(b) by 0 days.

(21) Appl. No.: 16/619,116

(22) PCT Filed: Jun. 7, 2018

(86) PCT No.: PCT/EP2018/065005
§ 371 (c)(1),
(2) Date: Dec. 4, 2019

(87) PCT Pub. No.: WO2018/228911
PCT Pub. Date: Dec. 20, 2018

(65) Prior Publication Data

US 2020/0194145 A1 Jun. 18, 2020

(30) Foreign Application Priority Data

Jun. 16, 2017 (DE) ..... 10 2017 210 096.6

(51) Int. Cl.
*H01B 11/02* (2006.01)
*H01B 11/08* (2006.01)
(Continued)

(52) U.S. Cl.
CPC ..... *H01B 11/08* (2013.01); *H01B 7/02* (2013.01); *H01B 7/2825* (2013.01)

(58) Field of Classification Search
CPC ..... H01B 7/02; H01B 7/2825; H01B 7/04; H01B 7/06; H01B 7/08; H01B 9/02; H01B 9/06; H01B 11/00; H01B 11/08
(Continued)

(56) References Cited

U.S. PATENT DOCUMENTS 2,800,524 A * 7/1957 Van Lear ..... H01B 7/29 174/116
3,843,568 A * 10/1974 Woodland ..... C08L 2666/04 521/54
(Continued)

FOREIGN PATENT DOCUMENTS

CN 207587415 A * 11/1997 ..... H01B 7/04
DE 1960252 6/1970
(Continued)

OTHER PUBLICATIONS

International Search Report and Written Opinion of the International Searching Authority for PCT/EP2018/065005, European Patent Office, dated Aug. 3, 2018.

*Primary Examiner* — William H. Mayo, III
(74) *Attorney, Agent, or Firm* — Williams Mullen; Thomas F. Bergert

(57) ABSTRACT

The invention relates to a data cable. One embodiment of the data cable has at least one pair of wires and a cable sheath surrounding the at least one pair of wires. The at least one pair of wires has two wires twisted together in the longitudinal direction of the data cable. Cavities between the at least one pair of wires and the cable sheath are at least partially filled with a filler. The filler has a viscosity which is such that it adheres in the data cable in such a way as to remain in the data cable at least nearly completely when there is a specified pressure difference between one end of the data cable and the other end of the data cable.

9 Claims, 2 Drawing Sheets

Figure 1:
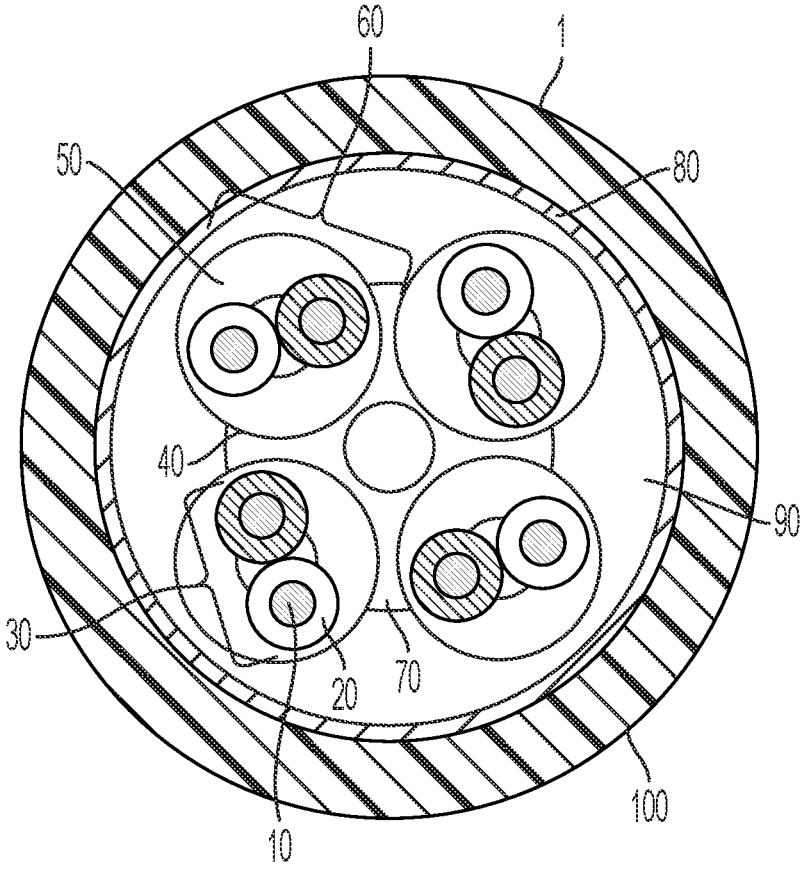

(51) Int. Cl.
*H01B 7/02* (2006.01)
*H01B 7/282* (2006.01)

(58) Field of Classification Search
USPC ..... 174/110 R–110 F, 102 R, 108, 109, 174/113 R, 120 R
See application file for complete search history.

(56) References Cited

U.S. PATENT DOCUMENTS 3,888,709 A * 6/1975 Burk ..... H01B 7/285 156/48
4,351,913 A * 9/1982 Patel ..... C08J 9/32 521/139
4,366,075 A 12/1982 Beach
4,621,169 A 11/1986 Petinelli et al.
9,424,963 B1 * 8/2016 McNutt ..... H01B 11/02
2009/0133895 A1 * 5/2009 Allen ..... H01B 7/2825 174/27
2015/0357095 A1 * 12/2015 Siripurapu ..... H01B 7/295 174/99 R
2018/0261358 A1 * 9/2018 Blaich ..... H01B 3/44

FOREIGN PATENT DOCUMENTS

| | | | | |
|---|---|---|---|---|
| DE | 2438533 | | 2/1975 | |
| DE | 2724795 | | 12/1978 | |
| DE | 2835677 | | 3/1980 | |
| DE | 10315609 | | 10/2004 | |
| EP | 1467381 | | 10/2004 | |
| EP | 2259270 | | 12/2010 | |
| EP | 2259270 | A2 * | 12/2010 | ..... H01B 7/285 |
| EP | 2388788 | | 11/2011 | |
| EP | 2800105 | A * | 4/2013 | ..... H01B 7/16 |
| EP | 3147913 | | 3/2017 | |
| JP | 2009224075 | | 10/2009 | |
| WO | 2005073983 | | 8/2005 | |

* cited by examiner

DATA CABLE FOR AREAS AT RISK OF EXPLOSION

CROSS-REFERENCE TO RELATED APPLICATIONS

This application is the U.S. national phase of international application PCT/EP2018/065005, filed on Jun. 7, 2018, which claims the benefit of German application DE 10 2017 210 096.6 filed on Jun. 16, 2017; all of which are hereby incorporated herein in their entirety by reference.

The present invention relates to a data cable.

BACKGROUND OF THE INVENTION

Field of the Invention

Data cables for the transmission of data (mostly termed data cables in brief below) are used in a wide variety of technical applications. A data cable is a medium for the transmission of signals, i.e. the data are usually transmitted with the aid of signals as data signals. The transmission can take place in principle on an electrical basis (electric data cable), optical basis (optical data cable) or a combination of both (normally termed a hybrid cable, sometimes also a combination cable).

Description of the Related Art

A known data cable, for example with the transmission properties of category 6, 6*a* or 7 according to International Electrotechnical Commission (IEC) 61156-5, has the following typical structure: it has four stranded wire pairs, wherein each wire is provided with a foamed dielectric that reacts with great sensitivity to mechanical lateral pressure. Each pair of wires is enveloped by an electric shield, e.g. a foil shield. The four shielded wire pairs are stranded together. The stranded bundle is enveloped by an electric shield, e.g. a braided shield. The overall structure is enveloped by an extruded cable sheath.

Due to its design, the structure described has a considerable "free area" in its cross section which is permeable to air. This "free area" leads to air being able to flow through the cable from one end to the other end. However, this is undesirable in explosion-protected zones in particular and when laying cables from explosion-protected zones to non-explosion-protected zones.

A method is known from the sphere of power cables or instrumentation cables for reducing these "free areas" considerably. In this, a filling mixture is extruded under significant pressure on the stranded bundle. This leads on the one hand to filling of these "free areas" with the filling mixture, on the other hand the pertinent structural elements of the cable are mostly significantly deformed by the extrusion pressure. This is also necessary to largely close the "free areas" located in deeper stranded layers and in the centre of the stranded bundle.

For data cables this procedure is not applicable, however, because by extruding filling mixtures under raised pressure, the foamed dielectric insulation layers of the data pairs and/or the electric shields around the wire pairs would be irreparably deformed, This would lead to impairment up to the loss of the electric transmission properties of data cables.

BRIEF SUMMARY OF THE INVENTION:

There is a requirement for data cables that are better suited to be able to be laid both in explosion-protected zones and in zones that lead from explosion-protected zones to non-explosion-protected zones.

For this a data cable is provided that has at least one pair of wires and a cable sheath enclosing the at least one pair of wires. The at least one pair of wires has two wires stranded together in the longitudinal direction of the data cable, Cavities existing between the at least one pair of wires and the cable sheath are at least partially filled with a filler. The filler has a viscosity such that it adheres in the data cable in such a way that it remains in the data cable at least nearly completely when there is a specified pressure difference between one end of the data cable and the other end of the data cable. For example, the filler can have such a viscosity that it adheres in the data cable in such a way that it remains in the data cable completely when there is a specified pressure difference between one end of the data cable and the other end of the data cable. A wire pair of a data cable can be understood here as a wire pair that is defined by technical transmission properties such as impedance, damping, return loss, near end crosstalk or far end crosstalk, for example.

Expressed in another way, the viscosity of the filler is selected such that the filler adheres in the data cable and is not pressed out of this in the event of a defined pressure difference between the two cable ends, Ideally the filler is easily processable in the context of cable manufacturing. The filler can further have such a viscosity that no deformation of the wire dielectrics (the dielectric around each wire) and of the geometrical structure of the at least one wire pair (which can also be termed a data transmission pair) occurs during the process of working the filler and/or in the course of cable utilisation. A (highly) viscous fluid, for example, can be used as a filler. With the aid of this filler, cavities existing in the data cable without the use of the filler can be filled at least partially. In a cross-sectional view of the data cable the cavities can also be termed "free areas" or "gussets".

With the aid of the configuration described, it can be achieved as an important attribute of the data cable that as little gas as possible can be exchanged through the data cable between various areas, for example the two ends, of the data cable. For example, gas escapes from non-explosion-protected zones into explosion-protected zones via data cables with higher transmission rates can be minimised or even prevented. Furthermore, gas escapes from explosion-protected zones into non-explosion-protected zones via data cables with higher transmission rates can be minimised or even prevented. This is achieved in that cavity volumes within the data cable are at least reduced and ideally minimised. Expressed another way, a cable construction is provided that has only a few or minimal cavity volumes (free areas in the cable cross section). Moreover, with the aid of this cable construction the flow of water or other liquid media through the data cable can be minimised or even prevented. Water in the cable constitutes a problem in many applications. The data cable can be an electric data cable.

The aforesaid stranding (often also termed twisting) is understood as the twisting with one another and the spiral/helical wrapping around one another of fibres or wires. In a twisted cable the individual conductors of a circuit change their place relative to one another in their progression. In the stranding of cables, individual wires, cores or bundles of wires are twisted with one another. They are wound spirally about a stranding axis/about a stranding centre. Due to the stranding/twisting the mutual influencing of electric conductors is reduced. The stranding/twisting is an effective measure for reducing inductively coupled series mode interference. In relation to the at least one pair of wires this means that the respective two wires of the at least one pair of wires are wound spirally in a longitudinal direction around a stranding axis/around a stranding centre.

The at least one pair of wires can be formed for data transmission. For example, each wire of the at least one pair of wires can be formed to transmit data.

In one exemplary embodiment, each wire of the at least one pair of wires is surrounded by a foamed or solid dielectric. In this case the filler can have such a viscosity that although the filler adjoins or adheres on the dielectric, at least nearly no deformation of the dielectric around the respective wire occurs. Put more precisely, each wire has a conductive element as conductor, which is surrounded by a foamed or solid dielectric. This means that each wire has a conductor and a foamed or solid dielectric surrounding or enclosing the conductor or is formed thereof.

The wall thickness and/or degree of foaming of the respective dielectric can be adapted to the filler. The gas located in the unfilled cavities, e.g. air, enters into the transmission properties of the data cable. By introducing the filler into the cavities, for example a viscous fluid, the transmission properties of the data cable change, for example the transmission properties of the at least one pair of wires. This applies both to foamed and to solidly designed dielectrics. To minimise this change and to achieve the transmission properties specified in the standard IEC 61156-5, for example, the wall thickness of the dielectric and/or the degree of foaming can be adapted accordingly. For example, the wall thickness of the dielectric and/or the degree of foaming can be varied compared with the wall thickness and/or the degree of foaming in the case of unfilled cavities.

In a first possible configuration the at least one pair of wires can be enveloped by a fluid-tight electric shield. The fluid-tight electric shield can be formed in such a way that it prevents at least as far as possible an introduction of the filler into a cavity delimited by the fluid-tight electric shield. This configuration can be used in particular with small pressure differences between the ends of the data cable of up to 1 bar as a simple realisation. With such small pressure differences the quantity of gas, e.g. air, flowing through the pertinent cavity is so small/not so significant. This applies all the more if the electric shield, e.g. foil shield, adapts tightly to the stranded bundle of the wire pair with an elliptical form, for example, and the cavity between the electric shield and the pair of wires is thereby reduced.

In a second possible configuration the at least one pair of wires can be enveloped by a fluid-permeable electric shield. The fluid-permeable electric shield can be formed so that it permits an introduction of the filler into a cavity delimited by the fluid-permeable electric shield. Following curing of the filler, the fluid-permeable electric shield can prevent the filler from escaping again. In addition, the possibility exists of applying at least one further foil (of whatever material) over this shield to prevent leakage. Furthermore, the cured filler can adhere to the pair of wires as described.

In one possible realisation it is conceivable that the filler has the viscosity at room temperature. It is possible that the filler at room temperature is both in a state in which it can be processed and in a state in which it adheres as described in the data cable. Expressed otherwise, the filler at room temperature can have the required viscosity for the process of working it and for long-term use in the data cable. As described, the filler, for example the fluid, is configured so that it adheres in the data cable and is not pressed out at a defined pressure difference between the two cable ends. Furthermore, it can ideally be processed easily in the context of cable manufacturing. For this, depending on the requirements in respect of the pressure difference between the two cable ends and the requirements arising from the production process, it is possible to use a filler, e.g. a fluid, which at room temperature already has the necessary viscosity for the process of working it and for the durable use of the required adhesion.

In another possible realisation it is conceivable that the filler has the viscosity at a temperature lying above room temperature, for example in a range from room temperature to 300° C. The temperature can comprise the overall extrusion temperature range of plastics, i.e. up to 300° C., for example for fluoropolymers, but also 45° C. or 60° C. depending on the material. The possibility thus exists of using a filler, e.g. a fluid, which is led during the working-up process to the required viscosity by heating and is then cooled down. Care should be taken here, however, to ensure that the cooled filler, e.g. the cooled fluid, which then acts like an extruded filling mixture, does not lead to a deformation of the dielectrics due to the mechanical strength produced and thus to an impairment of the transmission properties of the wire pairs/data pairs. This can be achieved by suitable measures such as e.g. the aforesaid adaptation of the wall thickness and/or of the degree of foaming.

The cavities filled with the filler can be filled to full volume with the filler, for example. According to one example all the cavities present without filler can be filled to full volume following introduction of the filler. According to another example a portion of the cavities present without filler can be filled to full volume following introduction of the filler. Expressed another way, the filler to be introduced, e.g. the fluid to be introduced, can fill at least some, but for example also all cavities (free areas in the cable cross section). It is ensured in this case in the production process, for example, that the filler, e.g. the fluid, does not run back out of the stranded bundle up to application of the cable sheath.

The viscosity can be selected as a function of the specified pressure difference and/or the processing temperature. Expressed otherwise, a filler can be used with a viscosity that is suitable for the specified pressure difference and/or the processing temperature such that it adheres in the data cable in such a way that it remains at least nearly completely in the data cable when there is a specified pressure difference between one end of the data cable and the other end of the data cable.

According to one example, at a pressure difference of up to 1 bar and a processing temperature of 120° C. the viscosity can lie in a range from 10 mPas to $10^3$ mPas, for example at $10^2$ mPas. According to another example, at a pressure difference of more than 1 bar and a processing temperature of 120° C. the viscosity can lie in a range from $10^4$ mPas to $10^8$ mPas. The corresponding viscosity values at lower temperatures, for example room temperature, are then correspondingly higher.

TW 3090 telephone cable grease or Oppanol® B12N can be named here purely by way of example as a possible filler.

The cavities can have a first cavity. The first cavity can be delimited outwardly by an electric overall shield lying inside the cable sheath, for example adjoining the cable sheath, and an electric shield around the at least one pair of wires.

The cavities can also have at least one second cavity. The at least one second cavity is delimited by an electric shield around the at least one pair of wires and the outer side of the dielectrics around each of the wires of the at least one pair of wires.

The at least one pair of wires can be formed as several pairs of wires, for example two, four, eight or more than eight wire pairs. The several wire pairs can be stranded with one another in the longitudinal direction of the data cable and thereby form a stranded bundle. An implementation as a so-called "star quad" is also conceivable, i.e. four wires stranded with one another (two pairs, but not in pairs). Star quads are known from the prior art and are therefore not described further at this point.

The number of second cavities can correspond to the number of the at least one pair of wires. For example, in the case of four wire pairs, four second cavities can exist. Each of these second cavities can be delimited by the electric shield around the corresponding pair of wires and the outer side of the dielectrics around each of the wires of this pair of wires.

According to the aforesaid first possible configuration, in which the at least one pair of wires is enveloped by a fluid-tight electric shield, the at least one second cavity remains e.g. completely unfilled. According to the aforesaid second possible configuration, in which the at least one pair of wires is enveloped by a fluid-permeable electric shield, the at least one second cavity is filled, such as e.g. completely filled, by introducing the filler.

BRIEF DESCRIPTION OF THE SEVERAL VIEWS OF THE DRAWING(S)

Figure 2:
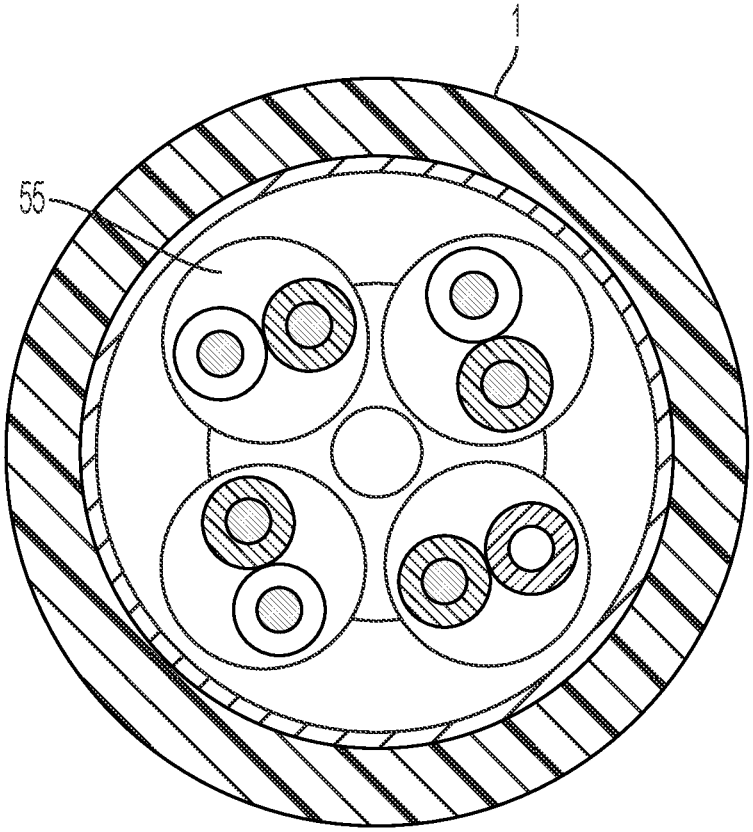

The present disclosure is to be explained further by means of figures. These figures show schematically:

FIG. 1 a possible configuration of a data cable according to a first exemplary embodiment; and FIG. 2 a possible configuration of a data cable according to a second exemplary embodiment.

DETAILED DESCRIPTION OF THE INVENTION

In the following, without being restricted to these, specific details are set out to provide a complete understanding of the present disclosure. However, it is clear to a person skilled in the art that the present disclosure can be used in other exemplary embodiments that may differ from the details set out below. For example, specific configurations and arrangements of a data cable are described below that should not be regarded as restrictive. Furthermore, various application fields of the data cable are conceivable.

FIG. 1 shows a data cable 1. The data cable 1 in FIG. 1 has, purely as an example and without being limited to the number shown, four wire pairs 30 as an example of at least one pair of wires 30 present in the data cable. Each of the four wire pairs 30 has two wires 10 stranded with one another in the longitudinal direction of the data cable. A wire 10 is formed from a conductor (pure metal), which is surrounded by a dielectric (insulation). Together with the insulation the conductor forms this same wire 10. Each wire 10 (each individual line for data transmission plus insulation) is enveloped by a dielectric 20 to insulate a wire 10 of a pair of wires 30 from an adjacent wire 10 of the pair of wires 30. Each of the wire pairs 30 is surrounded or enveloped by an electric shield 40, for example a foil shield. The pair of wires 30 and electric shield 40 can also be described as a data pair element 60. The four shielded wire pairs 40 (data pair elements 60) are stranded with one another. In the exemplary embodiment in FIG. 1, these four data pair elements 60 adjoin an inner element or central element seen centrally in cross section and are stranded around this inner element acting as a stranding centre. The stranded bundle resulting from the stranding is surrounded or enveloped by an electric overall shield 80, for example a foil shield. The overall structure formed from this, i.e. also the four wire pairs 40, are surrounded or enveloped by a cable sheath 100, which is extruded, for example.

Inside the data cable 1, i.e. inside the cable sheath 100 and the electric overall shield 80, there exist gas-filled, e.g. air-filled, cavities. In cross section these cavities appear as a free area. In FIG. 1, one of these free areas is designated by the reference sign 70. This means that due to the design, the described structure of the data cable 1 has in cross section a considerable "free area", which is gas-permeable, e.g. air-permeable. The free areas are often also termed "gussets".

In known data cables the areas provided with the reference signs 50 and 90 are likewise formed as such free areas. These free areas lead to gas, e.g. air, being able to flow through the data cable 1 from one end to the other end. However, this is undesirable in explosion-protected zones in particular and when laying cables from explosion-protected zones to non-explosion-protected zones.

In contrast, in the exemplary embodiment from FIG. 1, the areas provided with the reference signs 50 and 90 are provided with a filler/a filling mixture. This means that between each of the wire pairs 30 and the cable sheath 100, more precisely the electric overall shield 80, existing cavities are at least partially filled with a filler/a filling mixture. Expressed another way, at least a portion of the cavities/free areas existing in the data cable 1 are filled with a filler/a filling mixture. In the exemplary embodiment shown in FIG. 1, the area 90 is filled with a filler purely as an example and without being restricted hereto. The area 90 is bordered outwardly by the cable sheath 100, more precisely by the electric overall shield 80. Furthermore, four areas provided with the reference sign 50 are filled with filler. Each of these areas 50 belongs to one of the data pair elements 60. Outwardly each of these areas 50 is delimited by the associated electric shield 40 and inwardly each of these areas 50 is delimited by the outer side of the associated pair of wires 30 (the outer side of the associated dielectrics 20). In the example from FIG. 1, the free area 70 is unfilled purely by way of example. Alternatively the area 70 can also be filled at least partially by a filler.

Since an electric pair shield laid over the entire surface around the individual wire pairs 30 would largely prevent the filling of the free areas between the individual wire pairs 30/in the individual data pair elements 60, in the exemplary embodiment from FIG. 1 an electric shield 40 is used in each case that is permeable, at least in its state during the introduction/during the processing. Each of the electric shields 40 can therefore be formed as a fluid-permeable braided shield for electric pair shielding.

On the one hand, the filler thus acts from the area 90 in a radial direction on each of the electric shields 40. On the other hand, the filler acts from each of the areas 50 in a radial direction on the respective dielectrics 20 of the associated wires 10. The dielectrics 20 can be a foamed or a solid dielectric 20 in each case. Foamed dielectrics 20 in particular, but also solid dielectrics 20 react sensitively to mechanical lateral pressure. Too high a mechanical lateral pressure would irreparably deform the (foamed) dielectrics 20, i.e. the electric insulation layers, for example, of the data pairs/wire pairs 30. This would lead to impairment up to the loss of the transmission properties of the wires 10 and thus of the wire pairs 30.

As already stated, the filler has such a viscosity that it adheres in the data cable 1 in such a way that it remains in the data cable 1 at least nearly completely when there is a specified pressure difference between one end of the data cable 1 and the other end of the data cable 1. The ends of the data cable 1 should be understood as ends in the longitudinal direction of the data cable. The filler can be executed in this case as (highly) viscous fluid. The viscosity of the filler is selected such that it adheres in the data cable 1 on the one hand and is not pressed out of this when there is a defined pressure difference between the two cable ends. Furthermore, the filler should be workable easily in the context of cable manufacturing.

Depending on the pressure difference between the two cable ends and the requirements arising from the production process, the use of a fluid is possible that at room temperature already has the necessary viscosity for the working-up process and for long-term use. However, the possibility also exists of using a fluid that is led to the necessary viscosity by heating during the working-up process and is then cooled down. In the latter case care should be taken to ensure that the cooled fluid, which then acts like an extruded filling mixture, does not lead to deformation of the dielectrics 20 due to the mechanical strength produced and thus to impairment of the transmission properties of the data pairs 30.

One of the requirements of production process, for example, is that the fluid to be introduced fills all cavities (free areas in the cable cross section) if possible to full volume, for example, on the one hand, but on the other hand the fluid does not run back out of the stranded bundle up to application of the cable sheath. The viscosity of the filling material is geared in the solution to the pressure differences to be expected between the explosion-protected zone and the non-explosion-protected zone. At small pressure differences of less than 1 bar, the value can be in the order of $10^2$ mPas (at a reference temperature of 120° C. during processing) and at higher pressure differences can lie in a range from up to $10^5$ mPas to $10^7$ mPas (at a reference temperature of 120° C. during processing). The corresponding viscosity values at lower temperatures, for example room temperature, are then correspondingly higher. As an example of a material for low pressure differences the telephone cable grease TW 3090 could be used; for higher pressure differences Oppanol® B12N is suitable, for example. The use of other soft (high-viscosity) filling mixtures is also possible.

As outlined, to avoid impairment of the transmission properties as far as possible the filler should not result in deformation of the wire dielectrics 20 and the geometrical structure of the data transmission pairs 30 both during the working-up process and in the course of cable utilisation.

The data transmission pairs 30 are constructed as outlined above. To reduce or even completely avoid negative influences on the transmission properties, for example due to deformation of the dielectrics 20, the wall thickness of the respective dielectric 20 and/or the degree of foaming of the respective dielectric 20 (in the case of a foamed dielectric 20) can be adapted (compared with a configuration with unfilled free areas). This is based on the fact that gas (e.g. air) located in the free areas enters decisively into the transmission properties. With the use of a filler such as a viscous fluid, the transmission properties of the data transmission pair 30 change. However, to achieve the transmission properties specified in the standard IEC 61156-5, for example, the wall thickness of the dielectric 20 and/or the degree of foaming of a foamed dielectric 20 can be adapted. For example, the wall thickness of the dielectric 20, regardless of whether it is executed as a foamed or as a solid dielectric 20, can be increased to counteract deformation. Furthermore, the degree of foaming (foaming degree) of a dielectric 20 can be reduced to counteract deformation. The filler influences the electric transmission properties of the data pairs 30. Since the dielectric constant of air is approximately 1 and that of the fillers is greater than 1, it must be guaranteed either via the wall thickness of the dielectric (the insulation layer) and/or the degree of foaming of the dielectric that when replacing the air in the cable with the filler, the transmission properties are returned to the original extent that they were with air. Increasing the foaming degree makes the wires more sensitive. The foaming degree must therefore be reduced to counteract deformation.

FIG. 2 shows a data cable 1 according to a second exemplary embodiment. The data cable 1 according to the second exemplary embodiment is based on the data cable 1 according to the first exemplary embodiment from FIG. 1. The components of the data cable 1 from FIGS. 1 and 2 that are provided with the same reference figures correspond to one another. In contrast to the data cable 1 according to the first exemplary embodiment, the four areas 50 are unfilled and are therefore described as four second free areas 55 (four second cavities). This is achieved in that the electric shields 40 are formed around the wire pairs as fluid-tight shields 40, which prevent penetration of the filler into the free areas 55.

The second exemplary embodiment can be regarded as a simplified exemplary embodiment, which can be used with small pressure differences between the ends of the data cable 1, for example. Since with low pressure differences the quantity of gas, e.g. air, flowing through the free areas 55 is smaller and can be regarded as not significant, a fluid-tight electric shield 40, e.g. a fluid-tight foil shield, can be used around a respective pair of wires 30 (data transmission pair). The fluid-tight electric shield 40, e.g. the fluid-tight foil shield, can moreover adapt tightly to the stranded bundle of the wire pair 30 (which has at least nearly an elliptical form), which in turn reduces the quantity of gas, e.g. air, flowing through.

With the aid of the configurations from FIGS. 1 and 2, gas leakage from data cables that are to be used or laid in explosion-protected zones are reduced or even prevented.

The invention claimed is:

1. A data cable, comprising:

at least one pair of wires with two wires stranded with one another in the longitudinal direction of the data cable; and a cable sheath enveloping the at least one pair of wires;

wherein cavities existing between the at least one pair of wires and the cable sheath comprise a first cavity which is delimited outwardly by an electric overall shield lying inside the cable sheath, and at least one second cavity, wherein the at least one second cavity is delimited by a fluid-tight electric shield around the at least one pair of wires and the outer side of a dielectric around each wire of the at least one pair of wires, wherein the first cavity is filled at least partially with a filler, wherein the filler has such a viscosity that it adheres in the data cable in such a way that it remains in the data cable at least nearly completely when there is a specified pressure difference between one end of the data cable and the other end of the data cable, wherein the fluid-tight electric shield prevents at least as far as possible an introduction of the filler into the at least one a second cavity, wherein the viscosity in the event of a pressure difference of up to 1 bar and a processing temperature of 120° C. lies in a range from 10 mPas to $10^3$ mPas and the viscosity in the event of a pressure difference of more than 1 bar and a processing temperature of 120° C. lies in a range from $10^4$ mPas to $10^8$ mPas.

2. The data cable according to claim 1, wherein the dielectric comprises a dielectric surrounding each wire of the at least one pair of wires, wherein the dielectric is a foamed or solid dielectric, and wherein the filler has such a viscosity that at least nearly no deformation of the dielectric occurs around the respective wire.

3. The data cable according to claim 2, wherein the wall thickness and/or the degree of foaming of the respective dielectric are adapted to the filler.

4. The data cable according to claim 1, wherein the filler has the viscosity at room temperature.

5. The data cable according to claim 1, wherein the filler has the viscosity at a temperature lying above room temperature.

6. The data cable according to claim 1, wherein the first cavity is filled with the filler completely.

7. The data cable according to claim 1, wherein the viscosity is selected as a function of the specified pressure difference and/or the processing temperature.

8. The data cable according to claim 1, wherein the at least one pair of wires is formed as several wire pairs, wherein the several wire pairs are stranded with one another in the longitudinal direction of the data cable and form a stranded bundle thereby.

9. A data cable, comprising:

at least one pair of wires with two wires stranded with one another in the longitudinal direction of the data cable; and a cable sheath enveloping the at least one pair of wires;

wherein cavities existing between the at least one pair of wires and the cable sheath are filled at least partially with a filler, wherein the filler has such a viscosity that it adheres in the data cable in such a way that it remains in the data cable at least nearly completely when there is a specified pressure difference between one end of the data cable and the other end of the data cable, wherein the at least one pair of wires is enveloped by a fluid-tight electric shield, which prevents at least as far as possible an introduction of the filler into a cavity delimited by the fluid-tight electric shield, wherein the viscosity in the event of a pressure difference of up to 1 bar and a processing temperature of 120° C. lies in a range from 10 mPas to $10^3$ mPas and the viscosity in the event of a pressure difference of more than 1 bar and a processing temperature of 120° C. lies in a range from $10^4$ mPas to $10^8$ mPas.

* * * * *